US011367347B2

(12) United States Patent
Zhang

(10) Patent No.: US 11,367,347 B2
(45) Date of Patent: Jun. 21, 2022

(54) ENHANCED SENSOR OPERATION

(71) Applicant: Ford Global Technologies, LLC, Dearborn, MI (US)

(72) Inventor: Linjun Zhang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 228 days.

(21) Appl. No.: 16/798,637

(22) Filed: Feb. 24, 2020

(65) Prior Publication Data

US 2021/0264773 A1 Aug. 26, 2021

(51) Int. Cl.

| | |
|---|---|
| ***G08G 1/01*** | (2006.01) |
| ***G08G 1/015*** | (2006.01) |
| ***G08G 1/052*** | (2006.01) |
| ***G08G 1/056*** | (2006.01) |

(52) U.S. Cl.

CPC ..... *G08G 1/015* (2013.01); *G08G 1/0116* (2013.01); *G08G 1/052* (2013.01); *G08G 1/056* (2013.01)

(58) Field of Classification Search

CPC ..... G08G 1/0116; G08G 1/015; G08G 1/052; G08G 1/056; G08G 1/096783; G08G 1/166

USPC ..... 340/935

See application file for complete search history.

(56) References Cited

U.S. PATENT DOCUMENTS

| | | | | |
|---|---|---|---|---|
| 6,246,949 | B1 * | 6/2001 | Shirai | G01S 7/4972 701/96 |
| 8,760,521 | B2 | 6/2014 | Medeiros et al. | |
| 9,221,481 | B2 | 12/2015 | Desbordes et al. | |
| 10,012,981 | B2 | 7/2018 | Gariepy et al. | |
| 10,176,596 | B1 | 1/2019 | Mou | |
| 10,262,229 | B1 * | 4/2019 | Rao | G06V 10/431 |
| 10,276,043 | B2 | 4/2019 | Vijaya Kumar et al. | |
| 10,298,910 | B1 | 5/2019 | Kroeger | |
| 10,349,011 | B2 | 7/2019 | Du et al. | |
| 10,355,941 | B2 | 7/2019 | Tung et al. | |
| 10,403,135 | B2 | 9/2019 | Rosales et al. | |
| 2003/0132855 | A1 * | 7/2003 | Swan | G06Q 10/08 340/8.1 |
| 2005/0015201 | A1 * | 1/2005 | Fields | G08G 1/163 340/436 |

(Continued)

FOREIGN PATENT DOCUMENTS

| | | | |
|---|---|---|---|
| WO | 2017189361 | A1 | 11/2017 |

*Primary Examiner* — Naomi J Small

(74) *Attorney, Agent, or Firm* — Frank A. MacKenzie; Bejin Bieneman PLC

(57) ABSTRACT

A computer is programmed to collect first data with a stationary infrastructure sensor describing a first plurality of objects, the first data including at least one movable vehicle, identify a respective first bounding box for each of the first plurality of objects, and receive a message from the vehicle including second data describing a second plurality of objects, whereby at least one object is included in the first plurality of objects and the second plurality of objects. The computer identifies a respective second bounding box for each of the second plurality of objects. The computer identifies, for each object in both the first and second plurality of objects, a respective overlapping area of first and second bounding boxes. The computer transforms coordinates of the first data to coordinates of the second data upon determining that a mean value of the overlapping areas is below a threshold.

20 Claims, 5 Drawing Sheets

(56) References Cited

U.S. PATENT DOCUMENTS

| | | | | |
|---|---|---|---|---|
| 2008/0306708 | A1 | 12/2008 | Germain, IV et al. | |
| 2008/0309468 | A1* | 12/2008 | Greene | G08G 1/166 340/436 |
| 2011/0255741 | A1* | 10/2011 | Jung | G06V 20/58 382/103 |
| 2017/0061229 | A1* | 3/2017 | Rastgar | G06T 7/248 |
| 2018/0276910 | A1 | 9/2018 | Pitt et al. | |
| 2018/0283880 | A1 | 10/2018 | Croyle et al. | |
| 2018/0343303 | A1 | 11/2018 | Dudar et al. | |
| 2019/0045378 | A1 | 2/2019 | Rosales et al. | |
| 2019/0094331 | A1 | 3/2019 | Adireddy | |
| 2019/0108749 | A1 | 4/2019 | Gaither | |
| 2019/0140850 | A1 | 5/2019 | Ambrosin et al. | |
| 2019/0176841 | A1 | 6/2019 | Englard et al. | |
| 2019/0222652 | A1 | 7/2019 | Graefe et al. | |
| 2019/0285752 | A1* | 9/2019 | Chattopadhyay | G01S 17/931 |
| 2019/0295003 | A1 | 9/2019 | Dronen et al. | |
| 2019/0310650 | A1 | 10/2019 | Halder | |
| 2020/0143563 | A1* | 5/2020 | Liu | G06V 10/454 |
| 2020/0174130 | A1* | 6/2020 | Banerjee | G05D 1/0248 |
| 2020/0175864 | A1* | 6/2020 | Solmaz | G01S 5/02521 |
| 2020/0409363 | A1* | 12/2020 | Gogna | G05D 1/0276 |
| 2020/0410252 | A1* | 12/2020 | Tsoi | G05D 1/0246 |
| 2021/0025989 | A1* | 1/2021 | Vallespi-Gonzalez | G01S 13/865 |

* cited by examiner

ENHANCED SENSOR OPERATION

BACKGROUND

Vehicles can be equipped with computers, networks, sensors and controllers to acquire data regarding the vehicle's environment. The vehicle computers can use the acquired data to operate vehicle components. Vehicle sensors can provide data about a vehicle's environment, e.g., concerning routes to be traveled and objects to be avoided in the vehicle's environment. Further, vehicles can receive data from one or more external sources, e.g., a central server, a sensor mounted to infrastructure, etc.

DETAILED DESCRIPTION

Figure 1:
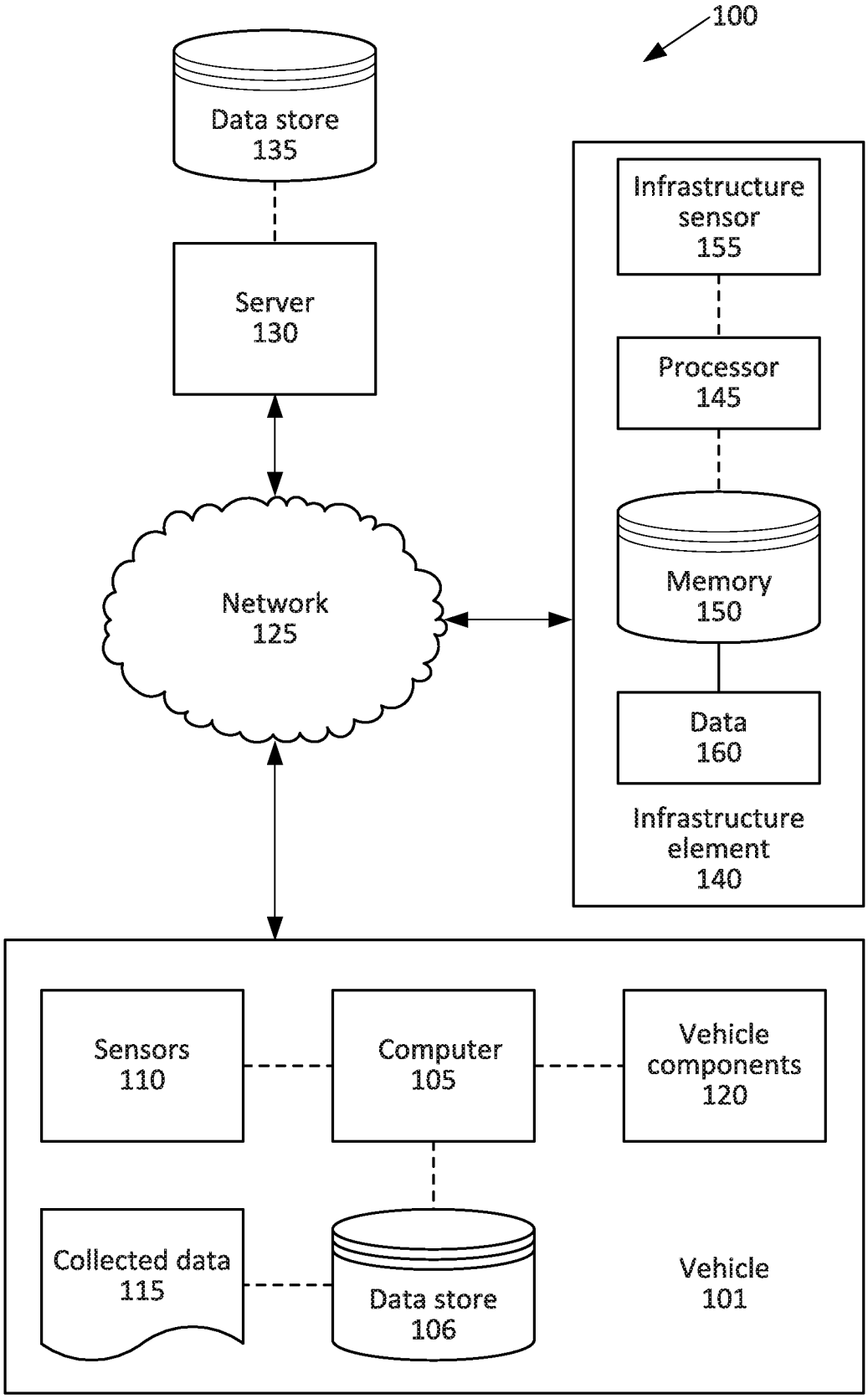
FIG. 1 is a block diagram of an example system for calibrating a sensor.

A system includes a computer including a processor and a memory, the memory including instructions executable by the processor to collect first data with a stationary infrastructure sensor describing a first plurality of objects, the first data including at least one movable vehicle, identify a respective first bounding box for each of the first plurality of objects including the at least one movable vehicle, receive a message from the at least one vehicle including second data describing a second plurality of objects, whereby at least one object is included in the first plurality of objects and the second plurality of objects, identify a respective second bounding box for each of the second plurality of objects, identify, for each object included in both the first plurality of objects and the second plurality of objects, a respective overlapping area of first and second bounding boxes from the first data and the second data, and transform coordinates of the first data to coordinates of the second data upon determining that a mean value of the overlapping areas is below a threshold.

The instructions can further include instructions to generate a transformation matrix that transforms the coordinates of the first data to the coordinates of the second data for one of the objects included in the first plurality of objects and the second plurality of objects, and to transform coordinates of the first data according to the transformation matrix.

The instructions can further include instructions to collect new first data with an infrastructure sensor describing a new first plurality of objects including at least one vehicle and to receive a new message including new second data from the at least one vehicle describing a new second plurality of objects, to generate a second transformation matrix that transforms coordinates of the new first data to coordinates of the new second data for at least one object included in the new first plurality of objects and the new second plurality of objects, and to transform the coordinates of the first data collected by the infrastructure sensor with the one of the transformation matrix or the second transformation matrix having a largest overlapping area of the first and second bounding boxes.

The transformation matrix can be a matrix that maps a first position and a first heading angle from the first data to a second position and a second heading angle from the second data.

The instructions can further include instructions to receive a plurality of messages from a plurality of vehicles until receiving second data about each of the first plurality of objects.

The instructions can further include instructions to identify, from the overlapping areas of the first and second bounding boxes around each of the plurality of objects, a largest overlapping area and to transform coordinates of the first data when the largest overlapping area is below a threshold.

Each of the first and second bounding boxes can be a boundary including data describing only one of the objects in both the first plurality of objects and the second plurality of objects.

The instructions can further include instructions to transform the coordinates of the first data upon determining that the second data includes data identifying an object not identified in the first data.

A system includes a computer in a movable host vehicle, the computer including a processor and a memory, the memory including instructions executable by the processor to compare identifying data of a plurality of objects received from a stationary infrastructure sensor to geo-coordinate data describing the host vehicle, upon determining that the geo-coordinate data describing the host vehicle is within a threshold of the received identifying data, send a message to a server indicating that the infrastructure sensor has detected the host vehicle, and upon determining that the geo-coordinate data describing the vehicle is not within the threshold of the identifying data received from the infrastructure sensor, send a message to the server indicating that the infrastructure sensor has not detected the host vehicle.

The instructions can further include instructions to compare an identified position or heading angle of one of the objects from the identifying data to the geo-coordinate data describing a current position or heading angle of the host vehicle based on a current speed of the vehicle and a time difference between a first timestamp of the identifying data and a second timestamp of the geo-coordinate data describing the host vehicle.

The server can be programmed to transform coordinates of data collected by the infrastructure sensor when a number of messages received by the server indicating that the infrastructure sensor has not detected one or more vehicles exceeds a threshold.

The server can be programmed to transform coordinates of data collected by the infrastructure sensor when a ratio between the number of messages received by the server indicating that the infrastructure sensor has not detected one or more vehicles and a number of the plurality of objects detected by the infrastructure sensor exceeds a second threshold for a time period exceeding a time threshold.

The infrastructure sensor can be programmed to, upon receiving a message from the server to transform coordinates of data collected by the infrastructure sensor, identify a transformation matrix that maps first data of a plurality of objects collected by the infrastructure sensor to second data about the plurality of objects sent by one or more vehicles to the infrastructure sensor.

The identifying data can include at least one type of object, the type being one of a vehicle, a pedestrian, or a cyclist.

The instructions can further include instructions to remove identifying data of objects including the pedestrian type or the cyclist type.

A method includes collecting first data with a stationary infrastructure sensor describing a first plurality of objects, the first data including at least one movable vehicle, identifying a respective first bounding box for each of the first plurality of objects including the at least one movable vehicle, receiving a message from the at least one vehicle including second data describing a second plurality of objects, whereby at least one object is included in the first plurality of objects and the second plurality of objects, identifying a respective second bounding box for each of the second plurality of objects, identifying, for each object included in both the first plurality of objects and the second plurality of objects, a respective overlapping area of first and second bounding boxes from the first data and the second data, and transforming coordinates of the first data to coordinates of the second data upon determining that a mean value of the overlapping areas is below a threshold.

The method can further include generating a transformation matrix that transforms the coordinates of the first data to the coordinates of the second data for one of the objects included in the first plurality of objects and the second plurality of objects, and transforming coordinates of the first data according to the transformation matrix.

The method can further include collecting new first data with an infrastructure sensor describing a new first plurality of objects including at least one vehicle and receiving a new message including new second data from the at least one vehicle describing a new second plurality of objects, generating a second transformation matrix that transforms coordinates of the new first data to coordinates of the new second data for at least one object included in the new first plurality of objects and the new second plurality of objects, and transforming the coordinates of the first data collected by the infrastructure sensor with the one of the transformation matrix or the second transformation matrix having a largest overlapping area of the first and second bounding boxes.

The method can further include receiving a plurality of messages from a plurality of vehicles until receiving second data about each of the first plurality of objects.

The method can further include identifying, from the overlapping areas of the first and second bounding boxes around each of the plurality of objects, a largest overlapping area and transforming coordinates of the first data when the largest overlapping area is below a threshold.

The method can further include transforming the coordinates of the first data upon determining that the second data includes data identifying an object not identified in the first data.

A method includes comparing identifying data of a plurality of objects received from a stationary infrastructure sensor to geo-coordinate data describing the host vehicle, upon determining that the geo-coordinate data describing the host vehicle is within a threshold of the received identifying data, sending a message to a server indicating that the infrastructure sensor has detected the host vehicle, and upon determining that the geo-coordinate data describing the vehicle is not within the threshold of the identifying data received from the infrastructure sensor, sending a message to the server indicating that the infrastructure sensor has not detected the host vehicle.

The method can further include comparing an identified position or heading angle of one of the objects from the identifying data to the geo-coordinate data describing a current position or heading angle of the host vehicle based on a current speed of the vehicle and a time difference between a first timestamp of the identifying data and a second timestamp of the geo-coordinate data describing the host vehicle.

The method can further include transforming coordinates of data collected by the infrastructure sensor when a number of messages received by the server indicating that the infrastructure sensor has not detected one or more vehicles exceeds a threshold.

The method can further include transforming coordinates of data collected by the infrastructure sensor when a ratio between the number of messages received by the server indicating that the infrastructure sensor has not detected one or more vehicles and a number of the plurality of objects detected by the infrastructure sensor exceeds a second threshold for a time period exceeding a time threshold.

The method can further include, upon receiving a message from the server to transform coordinates of data collected by the infrastructure sensor, identifying a transformation matrix that maps first data of a plurality of objects collected by the infrastructure sensor to second data about the plurality of objects sent by one or more vehicles to the infrastructure sensor.

The method can further include removing identifying data of objects including the pedestrian type or the cyclist type.

Further disclosed is a computing device programmed to execute any of the above method steps. Yet further disclosed is a vehicle comprising the computing device. Yet further disclosed is a computer program product, comprising a computer readable medium storing instructions executable by a computer processor, to execute any of the above method steps.

A computer processor in an infrastructure element can calibrate an infrastructure sensor according to data provided by a plurality of vehicles. The infrastructure sensor can collect data about a plurality of objects. Vehicle sensors can have finer resolution than the infrastructure sensor, and the data from the vehicle sensors can be more precise and accurate than data collected by the infrastructure sensor. The vehicle sensors can collect data about objects near the vehicle, i.e., the vehicle sensors collect more accurate data about fewer objects than the infrastructure sensor. The processor can compare the vehicle data to the infrastructure sensor data and can generate a mapping from the infrastructure data to the vehicle data. The mapping, e.g., a transformation matrix, can calibrate newly collected infrastructure sensor data, improving the precision and accuracy of the infrastructure sensor data. The vehicles can receive the infrastructure sensor data broadcast by the processor to identify nearby objects, e.g., for collision avoidance. Computers in the vehicles can determine whether the infrastructure sensor data includes data about their respective vehicles, i.e., whether the infrastructure sensor has detected the vehicles. If the infrastructure sensor has not detected the vehicles, the computers can send messages to a central server and/or to the processor indicating that the vehicles were not detected. When the central server and/or the processor determines that the number of undetected vehicles exceeds a predetermined threshold, the central server and/or the processor can calibrate the infrastructure sensor. Calibrating the infrastructure sensor with the more accurate localization data from the vehicles provides improved data transmitted by the infrastructure sensor to the vehicles. The improved data can include data about a plurality of objects that the vehicle sensors may not have detected. Vehicles can use the improved data from the infrastructure sensor to identify nearby objects without further operation of the vehicle sensors and perform operations, e.g., controlling speed and/or steering, based thereon.

FIG. 1 illustrates an example system 100 for calibrating a sensor 155 mounted to an infrastructure element 140. A computer 105 in a vehicle 101 is programmed to receive collected data 115 from one or more sensors 110. For example, vehicle 101 data 115 may include a location of the vehicle 101, data about an environment around a vehicle, data about an object outside the vehicle such as another vehicle, etc. A vehicle 101 location is typically provided in a conventional form, e.g., geo-coordinates such as latitude and longitude coordinates obtained via a navigation system that uses the Global Positioning System (GPS). Further examples of data 115 can include measurements of vehicle 101 systems and components, e.g., a vehicle 101 velocity, a vehicle 101 trajectory, etc. The vehicle 101 is movable, i.e., can move from a first location to a second location.

The computer 105 is generally programmed for communications on a vehicle 101 network, e.g., including a conventional vehicle 101 communications bus such as a CAN bus, LIN bus, etc., and or other wired and/or wireless technologies, e.g., Ethernet, WIFI, etc. Via the network, bus, and/or other wired or wireless mechanisms (e.g., a wired or wireless local area network in the vehicle 101), the computer 105 may transmit messages to various devices in a vehicle 101 and/or receive messages from the various devices, e.g., controllers, actuators, sensors, etc., including sensors 110. Alternatively or additionally, in cases where the computer 105 actually comprises multiple devices, the vehicle network may be used for communications between devices represented as the computer 105 in this disclosure. In addition, the computer 105 may be programmed for communicating with the network 125, which, as described below, may include various wired and/or wireless networking technologies, e.g., cellular, Bluetooth®, Bluetooth® Low Energy (BLE), wired and/or wireless packet networks, etc.

The data store 106 can be of any type, e.g., hard disk drives, solid state drives, servers, or any volatile or non-volatile media. The data store 106 can store the collected data 115 sent from the sensors 110. The data store 106 can be a separate device from the computer 105, and the computer 105 can retrieve information stored by the data store 106 via a network in the vehicle 101, e.g., over a CAN bus, a wireless network, etc. Alternatively or additionally, the data store 106 can be part of the computer 105, e.g., as a memory of the computer 105.

Sensors 110 can include a variety of devices. For example, various controllers in a vehicle 101 may operate as sensors 110 to provide data 115 via the host vehicle 101 network or bus, e.g., data 115 relating to vehicle speed, acceleration, position, subsystem and/or component status, etc. Further, other sensors 110 could include cameras, motion detectors, etc., i.e., sensors 110 to provide data 115 for evaluating a position of a component, evaluating a slope of a roadway, etc. The sensors 110 could, without limitation, also include short range radar, long range radar, lidar, and/or ultrasonic transducers.

Collected data 115 can include a variety of data collected in a vehicle 101. Examples of collected data 115 are provided above, and moreover, data 115 are generally collected using one or more sensors 110, and may additionally include data calculated therefrom in the computer 105, and/or at the server 130. In general, collected data 115 may include any data that may be gathered by the sensors 110 and/or computed from such data. The collected data 115 can be stored in the data store 106.

The vehicle 101 can include a plurality of vehicle components 120. In this context, each vehicle component 120 includes one or more hardware components adapted to perform a mechanical function or operation—such as moving the vehicle 101, slowing or stopping the vehicle 101, steering the vehicle 101, etc. Non-limiting examples of components 120 include a propulsion component (that includes, e.g., an internal combustion engine and/or an electric motor, etc.), a transmission component, a steering component (e.g., that may include one or more of a steering wheel, a steering rack, etc.), a brake component, a park assist component, an adaptive cruise control component, an adaptive steering component, a movable seat, and the like.

When the computer 105 operates the vehicle 101, the vehicle 101 is an "autonomous" vehicle 101. For purposes of this disclosure, the term "autonomous vehicle" is used to refer to a vehicle 101 operating in a fully autonomous mode. A fully autonomous mode is defined as one in which each of vehicle 101 propulsion (typically via a powertrain including an electric motor and/or internal combustion engine), braking, and steering are controlled by the computer 105. A semi-autonomous mode is one in which at least one of vehicle 101 propulsion (typically via a powertrain including an electric motor and/or internal combustion engine), braking, and steering are controlled at least partly by the computer 105 as opposed to a human operator. In a nonautonomous mode, i.e., a manual mode, the vehicle 101 propulsion, braking, and steering are controlled by the human operator.

The system 100 can further include a network 125 connected to a server 130 and a data store 135. The computer 105 can further be programmed to communicate with one or more remote sites such as the server 130, via the network 125, such remote site possibly including a data store 135. The network 125 represents one or more mechanisms by which a vehicle computer 105 may communicate with a remote server 130. Accordingly, the network 125 can be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth®, Bluetooth® Low Energy (BLE), IEEE 802.11, vehicle-to-vehicle (V2V) such as Dedicated Short Range Communications (DSRC), etc.), local area networks (LAN) and/or wide area networks (WAN), including the Internet, providing data communication services.

The system 100 includes an infrastructure element 140. In this context, an "infrastructure element" is a stationary structure near a roadway such as a pole, a bridge, a wall, etc. That is, the infrastructure element 140 is fixed to a single location. The infrastructure element 140 can include a processor 145 and a memory 150. The infrastructure element 140 can include an infrastructure sensor 155, i.e., the infrastructure sensor 155 is stationary. The infrastructure sensor 155 is mounted to the infrastructure element 140. The infrastructure sensor 155 collects data 160 about one or more objects on a roadway and stores the data 160 in the memory 150. The processor 145 can identify objects in the data 160 collected by the infrastructure sensor 155, e.g., vehicles 101, pedestrians, cyclists, etc. The processor 145 can communicate with the computer 105 and the server 130 over the network 125. For example, the processor 145 can broadcast data 160 to a plurality of computers 105 in respective vehicles 101 indicating objects identified by the infrastructure sensor 155.

Figure 2:
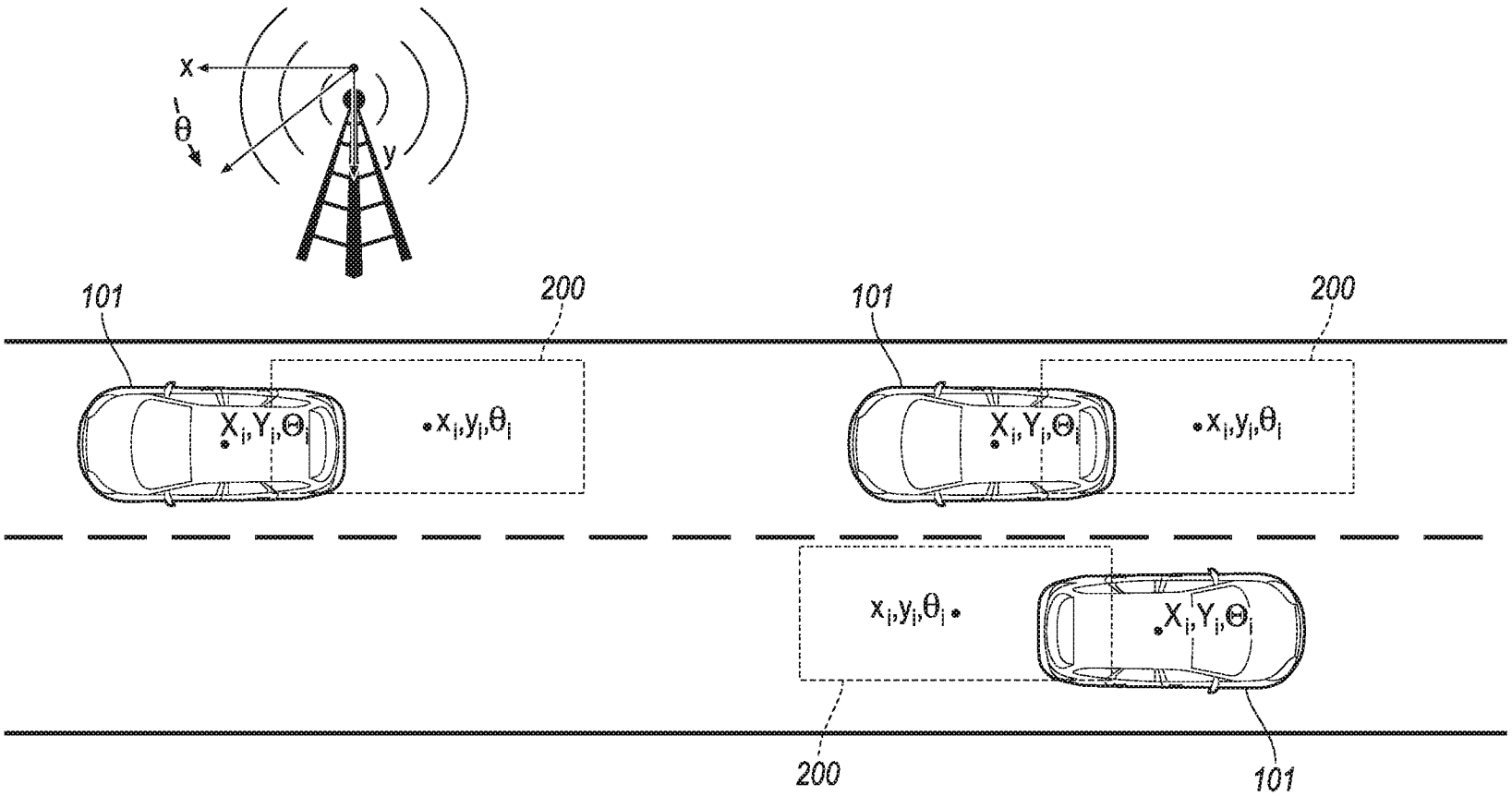
FIG. 2 is a view of a roadway including infrastructure and a plurality of vehicles.

FIG. 2 is a view of a roadway with a plurality of vehicles 101 and infrastructure element 140. The infrastructure element 140 collects data 160 about a plurality of objects on the roadway. That is, the infrastructure sensor 155 collects data 160, and the processor 145 analyzes the data 160 to identify one or more objects on the roadway. The objects can be, e.g., movable vehicles 101, cyclists, pedestrians, etc. The infrastructure sensor 155 detects a first plurality of objects. The processor 145 receives data 115 of a second plurality of objects from the computers 105 of the vehicles 101. That is, the infrastructure sensor 155 can detect objects that cannot send data 115 (e.g., nonautonomous vehicles, pedestrians, etc.), and the vehicles 101 can send data 115 that the infrastructure sensor 155 did not detect. Thus, the first plurality of objects detected by the infrastructure sensor 155 may differ from the second plurality of objects received by the processor 145 from the computer 105 of the vehicles 101. The processor 145 can receive a plurality of messages from a plurality of vehicles 101 until the processor 145 has received second data about each of the first plurality of objects.

The infrastructure sensor 155 can collect location data 160 of each object. In this context, "location data" are geo-coordinate data, e.g., a latitude coordinate and a longitude coordinate in a global geo-coordinate system. The data 160 include a position and a heading angle, as described below. FIG. 2 shows the infrastructure element 140 defining a global coordinate system with an x axis along lines of latitude (i.e., east and west directions) and a y axis along lines of longitude (i.e., north and south directions) and an origin at the infrastructure sensor 155. A "position" is a location in a coordinate system, e.g., the global geo-coordinate system, a local coordinate system, etc. The position in FIG. 2 is the x, y set of coordinates in the global coordinate system. A "heading angle" is an angle defined between a current trajectory of an object and an axis of the coordinate system, e.g., the angle θ defined from the positive y axis, i.e., the north direction, counterclockwise.

The infrastructure sensor 155 can collect identifying data 160 about each object, e.g., a color, a size, a make, model, etc. For example, the infrastructure sensor 155 can collect image data 160 about each object, and the processor 145 can use a conventional image-processing algorithm (e.g., Canny edge detection, a deep neural network, etc.) to identify the identifying data 160 for each object. The processor 145 can transmit the data 160 collected by the infrastructure sensor 155 for each object to one or more computers 105 in vehicles 101 within a broadcast radius of the infrastructure element 140.

The identifying data 160 can include a type of object. A "type" is a classification of the object that includes, at least implicitly, a movement capability of the object. The type can be, e.g., a vehicle 101, a cyclist, a pedestrian, etc., each have a respective movement capability. A movement capability includes a speed or speeds at which the object can travel, and possibly also other data, such as a turning radius. For example, a cyclist has a lower maximum speed than a vehicle 101, and collision avoidance with the cyclist can use different braking and steering techniques than collision avoidance with another vehicle 101.

The processor 145 can identify a bounding box 200 for each identified object. A "bounding box" is a boundary in which all data 160 of the identified object is included, and only the data 160 of the identified object is included. That is, the bounding box 200 defines a geographic area surrounding only the identified object.

Each computer 105 can receive data 160 from the processor 145 over the network 125, as described above. Each computer 105 can compare the data 160 received from the processor 145 and data 115 collected by sensors 110 of the vehicle 101 and/or stored in the data store 106. For example, the computer 105 of one of the vehicles 101 can compare the position data 160 from the processor 145 to a current position of the vehicle 101 from geo-coordinate data. That is, the data 160 from the processor 145 can include a plurality of positions of objects detected by the infrastructure sensor 155. If the computer 105 determines that one of the received positions in the data 160 substantially matches a current position of the vehicle 101, as described below, the computer 105 can determine that the infrastructure sensor 155 has detected the vehicle 101 in which the computer 105 is located. The computer 105 determines that the data 160 "substantially match" the current position and heading angle of the vehicle 101 when the position and heading angle provided by the data 160 are within respective thresholds of detected data 115, as described below. If the computer 105 determines that no data 160 substantially match the current position and heading angle of the vehicle 101, the computer 105 can determine that the infrastructure sensor 155 has not detected the vehicle 101. To reduce the amount of data 160 processed, the computer 105 can remove data 160 having a type that is a pedestrian type or a cyclist type. That is, the computer 105 can compare the position and heading angle of the vehicle 101 only to data 160 having a vehicle type.

The computer 105 can determine that the data 160 substantially matches the current position and heading angle of the vehicle 101 by comparing localization data 115 of the vehicle 101 to the data 160 adjusted for a time difference from communication latency:

$$|x(t')-X_i(t)|<v_x(t)|t'-t|+d \tag{1}$$

$$|y(t')-Y_i(t)|<v_y(t)|t'-t|+d \tag{2}$$

$$|\Theta(t')-\Theta_i(t)|<\omega(t)|t'-t|+\beta \tag{3}$$

where t is a current time that the computer 105 collects the position and heading angle data 115, t' is the timestamp of the data 160 from the processor 145, $v_x$ is the current speed of the vehicle 101 in the x direction, $v_y$ is the current speed of the vehicle 101 in the y direction, ω is the yaw rate of the vehicle 101 (i.e., the change in the heading angle θ in unit time), d is a distance threshold that is an accuracy of position detection of infrastructure sensor 155 (e.g., 1 meter), and β is an angle threshold that is an accuracy of heading angle detection of the infrastructure sensor 155 (e.g., 5 degrees). Because the processor 145 requires time to transmit the data 160 to the computer 105, the timestamp t' of the data 160 may differ from the collection time t by the computer 105. Thus, the difference between the position and heading angle data 115, 160 is compared to an estimated distance and heading angle change based on the time difference t'−t and the speed and yaw rate $v_x$, $v_y$, ω of the vehicle 101.

When at least one of the Equations 1-3 is satisfied, i.e., the data 160 substantially match at least one of the position X, Y or the heading angle Θ, the computer 105 can determine that the infrastructure sensor 155 has detected the vehicle 101. Otherwise, the computer 105 can determine that the infrastructure sensor 155 has not detected the vehicle 101. When the computer 105 determines that the infrastructure sensor 155 has not detected the vehicle 101, the computer 105 can send a message over the network 125 to the processor 145 and/or the server 130. The message can indicate that the infrastructure sensor 155 has not detected the vehicle 101.

The server 130 and/or the processor 145 can receive a plurality of messages from each of a plurality of vehicles 101 indicating that the infrastructure sensor 155 has not detected the vehicles 101. Because each message indicates a vehicle 101 that the infrastructure sensor 155 has not detected, the server 130 and/or the processor 145 can determine that the infrastructure sensor 155 requires calibration when the number of undetected vehicles 101 exceeds a threshold. That is, when the server 130 and/or the processor 145 receives a number of messages exceeding the threshold, the server 130 and/or the processor 145 can instruct the infrastructure sensor 155 to perform a recalibration procedure. The threshold can be a specified ratio of undetected vehicles 101 to total objects detected by the infrastructure sensor 155. For example, the threshold can be 0.30, i.e., the number of undetected vehicles 101 can be at least 30% of the total objects detected by the infrastructure sensor. The threshold can be determined based on, e.g., simulation testing of a virtual infrastructure sensor 155 detecting virtual objects at a specified miscalibration and lacking detection of virtual vehicles 101 at the specified miscalibration.

Alternatively or additionally, the server 130 and/or the processor 145 can determine to calibrate the infrastructure sensor 155 when the ratio between undetected objects and the number of total objects detected by the infrastructure sensor 155 exceeds a second threshold for a time period exceeding a time threshold. The second threshold can be a different percentage than the specified ratio described above, e.g., 50%. The time threshold can be an elapsed time beyond which the server 130 and/or the processor 145 determines that the infrastructure sensor 155 is no longer detecting sufficient objects to allow the vehicles 101 to perform object avoidance on the roadway. The time threshold can be determined based on, e.g., simulation testing of a virtual infrastructure sensor 155 detecting virtual objects at a specified miscalibration and lacking detection of virtual vehicles 101 at the specified miscalibration.

Figure 3:
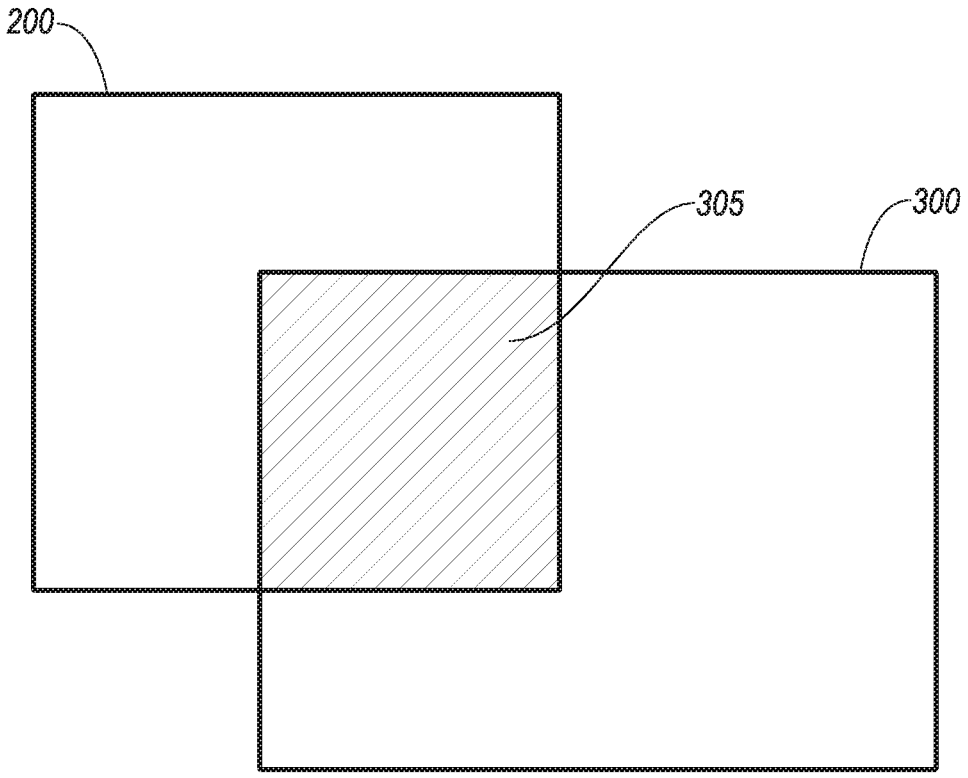
FIG. 3 is a diagram of a pair of bounding boxes of one of the vehicles.

FIG. 3 is a diagram of overlapping bounding boxes 200, 300. As described above, the bounding box 200 is the boundary determined by the infrastructure sensor 155 that includes data 160 from a single object. A computer 105 in a vehicle 101 can identify a vehicle bounding box 300 based on data 115 collected by one or more sensors 110. The vehicle bounding box 300 is a boundary identified by the sensors 110 that includes data 115 from the vehicle 101. That is, the vehicle bounding box 300 is a boundary that includes at least the vehicle 101, and the computer 105 can use the vehicle bounding box 300 to predict a collision with another object. For example, the computer 105 can actuate one or more components 120 to move the vehicle bounding box 300 away from a bounding box of another object. The bounding boxes 200, 300 are represented as rectangles in FIG. 3, and the bounding boxes 200, 300 can be a different shape, e.g., ellipses, other polygons, etc.

The computer 105 can determine an overlapping area 305 between the bounding boxes 200, 300. An "overlapping area" is an area within the bounding box 200 that is also within the vehicle bounding box 300. That is, the overlapping area 305 of the bounding boxes 200, 300 is the area where data 160 within the bounding box 200 matches data 115 within the vehicle bounding box 300. The computer 105 can compare location data 160 of the bounding box 200 received from the processor 145 and location data 115 of the vehicle bounding box 300 identified by the sensors 110 to determine the overlapping area 305. The computer 105 can determine an "overlapping ratio," i.e., the ratio of the overlapping area 305 to the total areas of the bounding boxes 200, 300:

$$R_{overlap} = \frac{A_{overlap}}{A_{BB} + A_{VBB} - A_{overlap}} \tag{4}$$

where $R_{overlap}$ is the overlapping ratio, $A_{overlap}$ is the area of the overlapping area 305, $A_{BB}$ is the area of the bounding box 200, and $A_{VBB}$ is the area of the vehicle bounding box 300.

The processor 145 can determine a mean overlapping ratio $\overline{R}_{overlap}$:

$$\overline{R}_{overlap} = \frac{\sum_i R_{overlap,i}}{N_{objects}} \tag{5}$$

where $N_{objects}$ is the number of objects detected by the infrastructure sensor 155 that have also sent data 115 to the processor 145 and $\Sigma_i R_{overlap,i}$ is the sum of the overlapping ratios, where i is a natural number from 1 to $N_{objects}$. That is, $N_{objects}$ is the number of sets of overlapping bounding boxes 200, 300. The mean overlapping ratio is thus a mean value of overlapping areas of the bounding boxes 200, 300 relative to the respective sizes of the bounding boxes 200, 300. When the mean overlapping ratio is below a predetermined threshold, the processor 145 can determine that the infrastructure sensor 155 requires calibration. The threshold can be determined based on simulation testing of a virtual infrastructure sensor 155 and virtual vehicles 101 at specific miscalibrations of the virtual infrastructure sensor 155 to identify a specific mean overlapping ratio at which one or more virtual vehicles 101 are no longer detected. The threshold can be at least 0.5, e.g., 0.7. When the mean overlapping ratio is below the threshold, the processor 145 can determine that the data 160 from the infrastructure sensor 155 is inaccurate and requires recalibration.

The processor 145 can determine a plurality of overlapping ratios from a plurality of vehicles 101. The processor 145 can identify a largest overlapping ratio, i.e., a largest overlapping area 305 relative to its overlapping bounding boxes 200, 300. The largest overlapping ratio indicates a vehicle 101 for which the data 160 from the infrastructure sensor 155 most closely aligns with data 115 from the sensors 110, i.e., a most accurate detection of the vehicle 101. The processor 145 can compare data 115 from the identified vehicle 101 with the largest overlapping ratio with the data 160 from the infrastructure sensor 155 corresponding to the identified vehicle 101. That is, the data 160 from the infrastructure sensor 155 can be a set $p_i=(x_i, y_i, \theta_i, 1)$ and the data 115 from the computer 105 can be a set $P_i=(X_i, Y_i, \Theta_i)$. The data 160 can include the position of the vehicle 101 in coordinate system $x_i$, $y_i$ and the heading angle $\theta_i$, and the final value of 1 allows the processor 145 to compute shift errors, i.e., errors in shift indexing between the data 160 and the data 115. The shift error is a constant value that compensates for a translation shift distance of the vehicle 101.

That is, the coordinates of the set $p_i$ are rotated in the global coordinate system, scaled to the set $P_i$, and translated to map onto the set $P_i$, e.g.:

$$X_i = a \cdot x_i + b \cdot y_i + c \cdot \Theta_i + s \tag{6}$$

where a, b, c, s are constant scalar values used to map the set $p_i$ to the set $P_i$. The shift error is the translation shift represented by the scalar value s. The data 115 from the vehicle 101 include geo-coordinate data 115, i.e., the position of the vehicle 101 in the global coordinate system $X_i$, $Y_i$ and the global heading angle $\Theta_i$.

The processor 145 can identify a transformation matrix $T_i$ that maps the set of position and heading angle data $p_i$ from the infrastructure sensor 155 to the set of position and heading angle data $P_i$ from the computer 105: $p_i T_i = P_i$. That is, $$T_i = p_i^{-1} P_i \tag{7}$$

where the −1 superscript indicates the pseudo-inverse operation. That is, because the set $p_i$ is a 1×4 matrix and the set $P_i$ is a 1×3 matrix, the transformation matrix $T_i$ is a 4×3 matrix of scalar values. Thus, to identify the transformation matrix $T_i$, the processor 145 determines, using a conventional technique such as least squares, a "pseudo-inverse" matrix $p_i^{-1}$ that is a 4×1 matrix. Because the sets $p_i$, $P_i$ are not square matrices, they do not have true inverse matrices, and the pseudo-inverse operation provides a pseudo-inverse matrix that the processor 145 can use to identify the transformation matrix $T_i$. The processor 145 can identify a transformation matrix $T_i$ for each vehicle 101 that sends data 115 over the network 125. For example, for n vehicles, the processor 145 can identify $T_1, T_2, \ldots T_n$ transformation matrices.

Alternatively or additionally, the processor 145 can identify a single transformation matrix T for all of the data 115 from the n vehicles 101. That is, the processor 145 can collect data 160 for the n vehicles 101 $p_1, p_2, \ldots p_n$ and the processor 145 can receive data 115 from the n vehicles 101 $P_1, P_2, \ldots P_n$ and can identify the transformation matrix T that transforms all of the data 160 to the data 115:

$$A = \begin{bmatrix} p_1 \\ \vdots \\ p_n \end{bmatrix}; B = \begin{bmatrix} P_1 \\ \vdots \\ P_n \end{bmatrix} \tag{8}$$

$$T = A^{-1} B \tag{9}$$

The processor 145 can collect the sets of data 160, shown as the matrix A, for a specified time period, and can receive the sets of data 115, shown as the matrix B for the specified time period to determine the transformation matrix T. The processor 145 can collect a plurality of sets of data 160 in a matrix $A_k$, where k is an integer from 1 to m representing one of m specified time periods. That is, for each increment of k, the processor 145 collects a new set of data $A_k$ from the infrastructure sensor 155 and a new set of data $B_k$ from the vehicles 101. The processor 145 can receive a plurality of sets of data 115 in a matrix $B_k$ and can identify a transformation matrix $T_k$ for the kth time period. Thus, the processor can determine a plurality of transformation matrices $T_1, T_2, \ldots T_m$.

Upon identifying the transformation matrices $T_k$, the processor 145 can identify the transformation matrix T* associated with sets $A_k$, $B_k$ having the highest mean overlapping ratio $\overline{R}_{overlap}$, as described above. That is, the data $A_k$, $B_k$ with the highest mean overlapping ratio $\overline{R}_{overlap}$ represents the most accurate data 160 collected by the infrastructure sensor 155 when compared to the data 115 received from the vehicles 101. The transformation matrix T*, being associated with the data $A_k$, $B_k$ with the highest mean overlapping ratio $\overline{R}_{overlap}$, is considered to be the most accurate transformation from the data 160 from the infrastructure element 140 to the data 115 from the vehicle 101. The processor 145 can use the transformation matrix T* to calibrate new data 160 received by the infrastructure sensor 155, i.e., can transform the data 160 according to the transformation matrix T*. Calibrating data 160 according to the transformation matrix T* aligns the data 160 most closely to the data 115 from the vehicles 101.

Figure 4:
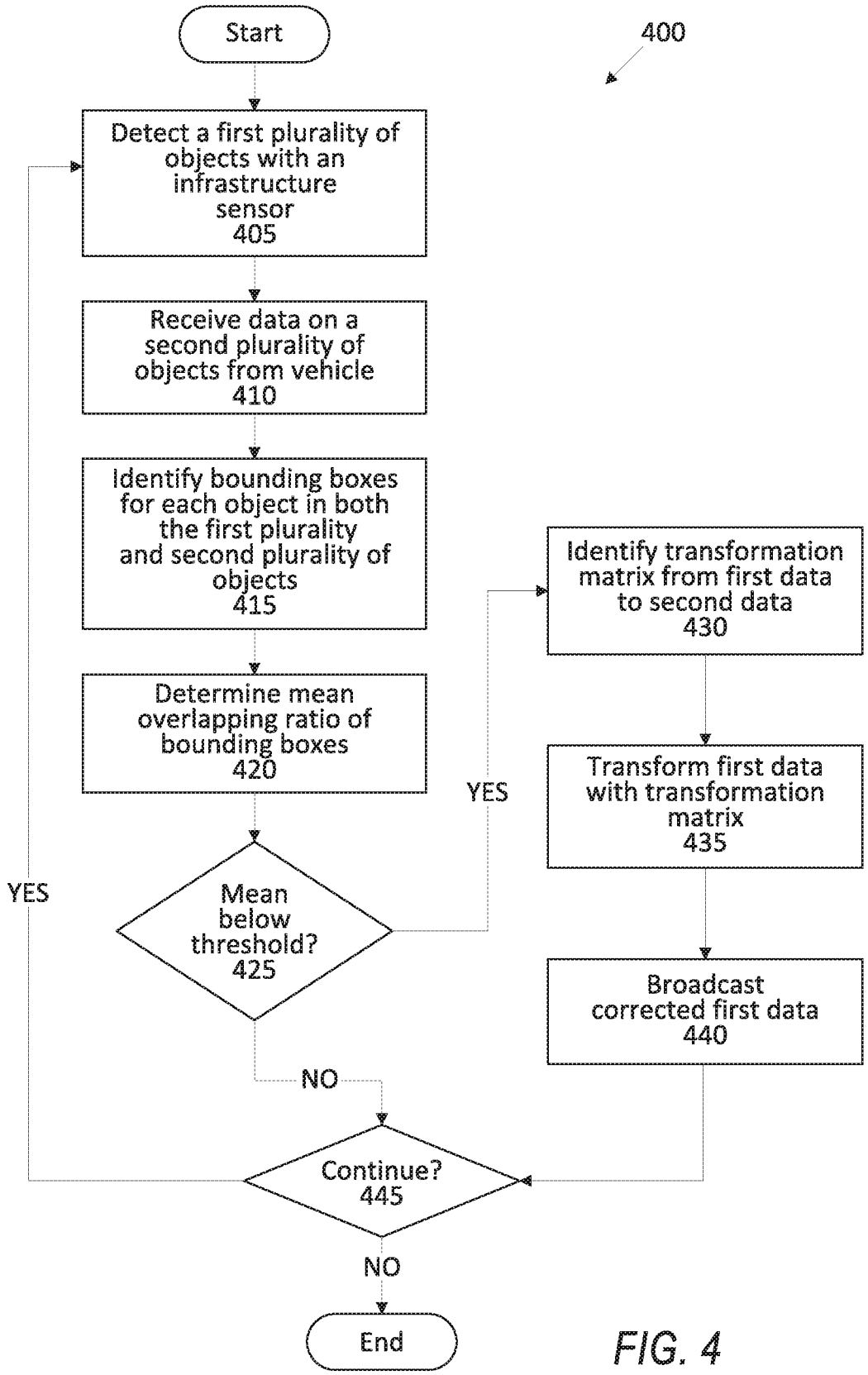
FIG. 4 is a diagram of an example process for calibrating the sensor.

FIG. 4 is a diagram of an example process 400 for calibrating an infrastructure sensor 155. The process 400 begins in a block 405, in which an infrastructure sensor 155 installed on infrastructure element 140 detects a first plurality of objects. The infrastructure sensor 155 can collect data 160 about the first plurality of objects, i.e., first data 160. In this context, the adjectives "first" and "second" are used for convenience to distinguish elements and do not specify order. The first data 160 can include, e.g., a position and a heading angle for each of the first plurality of objects. The infrastructure sensor 155 can store the first data 160 in the memory 150.

Next, in a block 410, a processor 145 installed on the infrastructure element 140 receives second data 115 describing a second plurality of objects from one or more vehicles 101. Each computer 105 in each vehicle 101 can actuate one or more sensors 110 to collect second data 115 about the respective vehicle 101 and/or objects near the vehicle 101. For example, each computer 105 can identify geo-coordinate data 115 of the vehicle 101 from a global satellite network, e.g., a Global Position System (GPS) network. The processor 145 can receive the second data 115 of the second plurality of objects over the network 125.

Next, in a block 415, the processor 145 identifies a bounding box 200 for each object detected by the infrastructure sensor 155 and a vehicle bounding box 300 for each set of received second data 115 from the vehicles 101. As described above, a "bounding box" is a boundary that includes data 115, 160 corresponding to one object. The processor 145 identifies respective bounding boxes 200, 300 for each object in the first plurality of objects and the second plurality of objects.

Next, in a block 420, the processor 145 determines a mean overlapping ratio of the bounding boxes 200, 300. As described above, the processor 145 can determine an overlapping area for each pair of the bounding box 200 and the vehicle bounding box 300 for one of the vehicles 101. The processor 145 can determine an overlapping ratio of the overlapping area, i.e., a ratio of the overlapping area to the total areas of the bounding boxes 200, 300. As described above, the mean overlapping ratio is the mean value of the respective overlapping ratios for all pairs of bounding boxes 200, 300 for the objects.

Next, in a block 425, the processor 145 determines whether the mean overlapping ratio is below a threshold. As described above, the processor 145 can compare the mean overlapping ratio to a predetermined threshold that is a percent difference between the first data 160 collected by the infrastructure sensor 155 and the second data 115 collected by the computers 105. If the mean overlapping ratio is below the threshold, the process 400 continues in a block 430. Otherwise, the process 400 continues in a block 445.

In the block 430, the processor 145 identifies a transformation matrix that transforms the first data 160 to the second data 115. That is, as described above, the transformation matrix maps the first data 160 to substantially match the second data 115. The processor 145 can identify the transformation matrix by taking a pseudo-inverse of a matrix including the first data 160. The processor 145 can identify the transformation matrix for the set of first data 160 and second data 115 corresponding to the highest overlapping ratio, as described above.

Next, in a block 435, the processor 145 transforms the first data 160 with the transformation matrix. That is, the processor 145 can apply the transformation matrix to all of the first data 160 to get corrected first data 160. That is, the processor 145 recalibrates the infrastructure sensor 155 by applying the transformation matrix to correct the first data 160.

Next, in a block 440, the processor 145 broadcasts the corrected first data 160 to one or more computers 105 in respective vehicles 101 over the network 125. Having transformed the first data 160 with the transformation matrix to generate the corrected first data 160, the computers 105 can receive more accurate positions and heading angles of the first plurality of objects. That is, the computers 105 can identify objects from the corrected first data 160 that respective sensors 110 of the vehicles 101 may not detect. Thus the processor 145 can use the first data 160 from the infrastructure sensor 155 about the first plurality of objects on the roadway with the more accurate and precise localization data 115 from the vehicles 101 to provide more accurate and precise positions and heading angles for the first plurality of objects to the vehicles 101.

In the block 445, the processor 145 determines whether to continue the process 400. For example, the processor 145 can determine to continue the process 400 upon receiving an instruction from a server 130 to recalibrate the infrastructure sensor 155. If the processor 145 determines to continue, the process 400 returns to the block 405. Otherwise, the process 400 ends.

Figure 5:
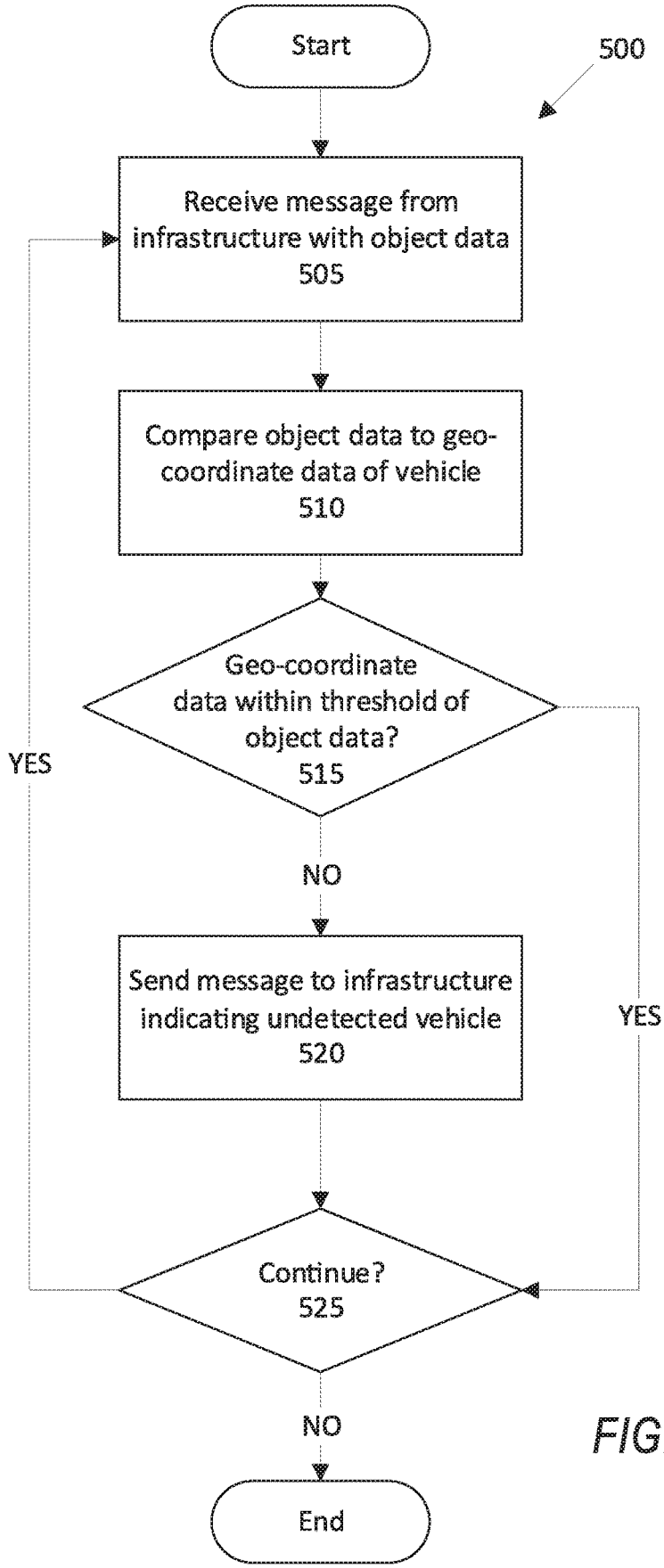
FIG. 5 is a diagram of an example process for determining to calibrate the sensor.

FIG. 5 is a diagram of an example process 500 for determining to calibrate an infrastructure sensor 155. The process 500 begins in a block 505, in which a computer 105 in a host vehicle 101 receives a message from a processor 145 of infrastructure element 140. The message can include first data 160 of a plurality of objects detected by the infrastructure sensor 155.

Next, in a block 510, the computer 105 compares the first data 160 to geo-coordinate data 115 of the host vehicle 101. The computer 105 can receive geo-coordinate data 115 from a server 130 indicating a position and a heading angle of the host vehicle 101 in a global coordinate system. The computer 105 can compare each set of data 160 corresponding to each object detected by the infrastructure sensor 155 to the geo-coordinate data 115 of the host vehicle 101.

Next, in a block 515, the computer 105 determines whether the geo-coordinate data 115 is within a threshold of any set of the first data 160. When at least one of a position or a heading angle of the first data 160 are within predetermined thresholds of the geo-coordinate data 115, the computer 105 can determine that the infrastructure sensor 155 has detected the host vehicle 101. The thresholds can be resolution errors of the infrastructure sensor 155, e.g., 1 meter for position and 5 degrees for heading angle. If the geo-coordinate data 115 are within the threshold of the first data 160, the process 500 continues in a block 525. Otherwise, the computer 105 determines that the infrastructure sensor 155 has not detected the host vehicle 101 and the process 500 continues in a block 520.

In the block 520, the computer 105 sends a message to the processor 145 of the infrastructure element 140 and/or the server 130 indicating that the infrastructure sensor 155 has not detected the host vehicle 101. The message can include the geo-coordinate data 115 of the host vehicle 101. When the processor 145 and/or the server 130 receives a number of messages indicating undetected vehicles 101 that exceeds a threshold, the processor 145 and/or the server 130 can determine that the infrastructure sensor 155 requires calibration, e.g., according to the process 400 above.

In the block 525, the computer 105 determines whether to continue the process 500. For example, the computer 105 can determine to continue the process 500 when approaching another infrastructure element 140. If the computer 105 determines to continue, the process 500 returns to the block 505. Otherwise, the process 500 ends.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, data collector measurements, computations, processing time, communications time, etc.

Computers 105 generally each include instructions executable by one or more computing devices such as those identified above, and for carrying out blocks or steps of processes described above. Computer executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in the computer 105 is generally a collection of data stored on a computer readable medium, such as a storage medium, a random access memory, etc.

A computer readable medium includes any medium that participates in providing data (e.g., instructions), which may be read by a computer. Such a medium may take many forms, including, but not limited to, non volatile media, volatile media, etc. Non volatile media include, for example, optical or magnetic disks and other persistent memory. Volatile media include dynamic random access memory (DRAM), which typically constitutes a main memory. Common forms of computer readable media include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 500, one or more of the steps could be omitted, or the steps could be executed in a different order than shown in FIG. 5. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The article "a" modifying a noun should be understood as meaning one or more unless stated otherwise, or context requires otherwise. The phrase "based on" encompasses being partly or entirely based on.

The adjectives "first," "second," and "third" are used throughout this document as identifiers and are not intended to signify importance or order.

What is claimed is:

1. A system, comprising a computer including a processor and a memory, the memory including instructions executable by the processor to:

collect first data with a stationary infrastructure sensor describing a first plurality of objects, the first data including at least one movable vehicle;

identify a respective first bounding box for each of the first plurality of objects including the at least one movable vehicle;

receive a message from the at least one vehicle including second data describing a second plurality of objects, whereby at least one object is included in the first plurality of objects and the second plurality of objects;

identify a respective second bounding box for each of the second plurality of objects;

identify, for each object included in both the first plurality of objects and the second plurality of objects, a respective overlapping area of first and second bounding boxes from the first data and the second data; and transform coordinates of the first data to coordinates of the second data upon determining that a mean value of the overlapping areas is below a threshold.

2. The system of claim 1, wherein the instructions further include instructions to generate a transformation matrix that transforms the coordinates of the first data to the coordinates of the second data for one of the objects included in the first plurality of objects and the second plurality of objects, and to transform coordinates of the first data according to the transformation matrix.

3. The system of claim 2, wherein the instructions further include instructions to collect new first data with an infrastructure sensor describing a new first plurality of objects including at least one vehicle and to receive a new message including new second data from the at least one vehicle describing a new second plurality of objects, to generate a second transformation matrix that transforms coordinates of the new first data to coordinates of the new second data for at least one object included in the new first plurality of objects and the new second plurality of objects, and to transform the coordinates of the first data collected by the infrastructure sensor with the one of the transformation matrix or the second transformation matrix having a largest overlapping area of the first and second bounding boxes.

4. The system of claim 2, wherein the transformation matrix is a matrix that maps a first position and a first heading angle from the first data to a second position and a second heading angle from the second data.

5. The system of claim 1, wherein the instructions further include instructions to receive a plurality of messages from a plurality of vehicles until receiving second data about each of the first plurality of objects.

6. The system of claim 1, wherein the instructions further include instructions to identify, from the overlapping areas of the first and second bounding boxes around each of the plurality of objects, a largest overlapping area and to transform coordinates of the first data when the largest overlapping area is below a threshold.

7. The system of claim 1, wherein each of the first and second bounding boxes is a boundary including data describing only one of the objects in both the first plurality of objects and the second plurality of objects.

8. The system of claim 1, wherein the instructions further include instructions to transform the coordinates of the first data upon determining that the second data includes data identifying an object not identified in the first data.

9. A system, comprising a computer in a movable host vehicle, the computer including a processor and a memory, the memory including instructions executable by the processor to:

compare identifying data of a plurality of objects received from a stationary infrastructure sensor to geo-coordinate data describing the host vehicle;

upon determining that the geo-coordinate data describing the host vehicle is within a threshold of the received identifying data, send a message to a server indicating that the infrastructure sensor has detected the host vehicle; and upon determining that the geo-coordinate data describing the vehicle is not within the threshold of the identifying data received from the infrastructure sensor, send a message to the server indicating that the infrastructure sensor has not detected the host vehicle.

10. The system of claim 9, wherein the instructions further include instructions to compare an identified position or heading angle of one of the objects from the identifying data to the geo-coordinate data describing a current position or heading angle of the host vehicle based on a current speed of the vehicle and a time difference between a first timestamp of the identifying data and a second timestamp of the geo-coordinate data describing the host vehicle.

11. The system of claim 9, wherein the server is programmed to transform coordinates of data collected by the infrastructure sensor when a number of messages received by the server indicating that the infrastructure sensor has not detected one or more vehicles exceeds a threshold.

12. The system of claim 11, wherein the server is programmed to transform coordinates of data collected by the infrastructure sensor when a ratio between the number of messages received by the server indicating that the infrastructure sensor has not detected one or more vehicles and a number of the plurality of objects detected by the infrastructure sensor exceeds a second threshold for a time period exceeding a time threshold.

13. The system of claim 11, wherein the infrastructure sensor is programmed to, upon receiving a message from the server to transform coordinates of data collected by the infrastructure sensor, identify a transformation matrix that maps first data of a plurality of objects collected by the infrastructure sensor to second data about the plurality of objects sent by one or more vehicles to the infrastructure sensor.

14. The system of claim 9, wherein the identifying data includes at least one type of object, the type being one of a vehicle, a pedestrian, or a cyclist.

15. The system of claim 14, wherein the instructions further include instructions to remove identifying data of objects including the pedestrian type or the cyclist type.

16. A method, comprising:

collecting first data with a stationary infrastructure sensor describing a first plurality of objects, the first data including at least one movable vehicle;

identifying a respective first bounding box for each of the first plurality of objects including the at least one movable vehicle;

receiving a message from the at least one vehicle including second data describing a second plurality of objects, whereby at least one object is included in the first plurality of objects and the second plurality of objects;

identifying a respective second bounding box for each of the second plurality of objects;

identifying, for each object included in both the first plurality of objects and the second plurality of objects, a respective overlapping area of first and second bounding boxes from the first data and the second data; and transforming coordinates of the first data to coordinates of the second data upon determining that a mean value of the overlapping areas is below a threshold.

17. The method of claim 16, further comprising generating a transformation matrix that transforms the coordinates of the first data to the coordinates of the second data for one of the objects included in the first plurality of objects and the second plurality of objects, and transforming coordinates of the first data according to the transformation matrix.

18. The method of claim 17, wherein the transformation matrix is a matrix that maps a first position and a first heading angle from the first data to a second position and a second heading angle from the second data.

19. The method of claim 16, further comprising receiving a plurality of messages from a plurality of vehicles until receiving second data about each of the first plurality of objects.

20. The method of claim 16, further comprising transforming the coordinates of the first data upon determining that the second data includes data identifying an object not identified in the first data.

* * * * *